United States Patent [19]

McConnell

[11] 4,237,853

[45] Dec. 9, 1980

[54] DRESSER DESIGN

[75] Inventor: Robert B. McConnell, Urbana, Ohio

[73] Assignee: The Desmond-Stephan Mfg. Company, Urbana, Ohio

[21] Appl. No.: 8,120

[22] Filed: Jan. 31, 1979

[51] Int. Cl.[3] ..... B28D 5/02

[52] U.S. Cl. ..... 125/37

[58] Field of Search ..... 125/11 R, 11 CD, 37

[56] References Cited

U.S. PATENT DOCUMENTS

| | | | |
|---|---|---|---|
| 272,615 | 2/1883 | Andrews . | |
| 1,339,452 | 5/1920 | Gorham . | |
| 1,382,176 | 6/1921 | Dobson | 125/37 |
| 1,526,496 | 2/1925 | Hohnhorst et al. . | |
| 1,805,514 | 5/1931 | DeMattia . | |
| 1,811,933 | 6/1931 | Hohnhorst et al. . | |
| 1,878,763 | 9/1932 | Dovell et al. . | |
| 2,742,891 | 4/1956 | Wise . | |
| 2,787,095 | 4/1957 | Lovett | 125/37 X |
| 2,926,654 | 3/1960 | Johnston | 125/37 |

FOREIGN PATENT DOCUMENTS

| | | | |
|---|---|---|---|
| 881609 | 4/1943 | France | 125/37 |
| 576396 | 4/1946 | United Kingdom | 125/11 CD |

*Primary Examiner*—Harold D. Whitehead

*Attorney, Agent, or Firm*—Biebel, French & Nauman

[57] ABSTRACT

A dresser for roughening the surface of an abrasive wheel has a cutter means for rotation in contact with the abrasive wheel. The cutter means includes a plurality of cutter teeth mounted on a cutter shaft. Ball bearings at each end of the cutter shaft permit the cutter means to rotate freely when held against an abrasive wheel as the wheel is rotated. A pair of hexagonal bearing supports each define a bearing receiving recess for receiving the ball bearings mounted at each end of the cutter shaft. Each of the bearing supports also defines a threaded, bolt receiving opening. A dresser body defines a cavity receiving the cutter unit and slots on opposite sides of the cavity receiving the bearing supports. The dresser body has bolt holes extending from the exterior of the body into the cavity through each of the slots. The dresser body includes a dresser handle which permits the dresser to be manipulated manually. Cutter supporting bolts extend from the exterior of the dresser body through the bolt holes into the cavity and engage the threaded bolt receiving openings in the bearing supports. A pair of locating ridges on the exterior of the body extend parallel to the cutter shaft, permitting accurate location of the dresser on an abrasive wheel tool rest with respect to the abrasive wheel. In an alternative embodiment, a dresser mounting plate is pivotally attached to the dresser body and, further, pivotally attached to the abrasive wheel tool rest, such that the dresser may be quickly pivoted into position for dressing the abrasive wheel.

7 Claims, 6 Drawing Figures

DRESSER DESIGN

BACKGROUND OF THE INVENTION

The present invention relates to a dresser for an abrasive grinding wheel and, more particularly, to a dresser having an improved bearing arrangement facilitating replacement of dresser cutter units. The dresser of the present invention facilitates positioning the dresser with respect to an abrasive wheel for rapid dressing of the wheel.

Prior art dressers have generally included a dresser body upon which a cutter unit, including a plurality of sharp metal teeth, is rotatably mounted. The teeth of the cutter unit are relatively hard and, when held against a rotating abrasive wheel, tend to roughen, or dress, the wheel surface.

Various bearing arrangements have been used to mount the cutter unit on the dresser body so that it may rotate freely when held against the abrasive wheel. A sleeve bearing arrangement, while simple to manufacture, is subject to rapid wear. As a consequence a dresser having a pair of hexagonal bearing supports, each such support including a plurality of sleeve bearing holes for receiving the shaft of a cutter unit, was developed. Such a dresser is shown in U.S. Pat. No. 1,382,176, issued June 21, 1921, to Dobson. An improvement of this design is shown in U.S. Pat. No. 2,926,654, issued Mar. 1, 1960, to Johnston. The hexagonal bearing supports of Dobson and Johnston are held in slots on opposite sides of the dresser body and may be removed and reinserted into the body when it is desired to change the sleeve bearing holes in which the cutter unit is mounted. Although providing for improved bearing life over prior art sleeve bearing dresser designs, the sleeve bearings of Dobson and Johnston required frequent changing of the bearing holes being utilized as the holes became worn.

Accordingly many prior art dressers utilized ball bearing support arrangements for mounting the cutter unit. Abrasive grinding wheel dressers having ball bearings for mounting the cutter unit, such as shown in U.S. Pat. No. 1,878,763, issued Sept. 20, 1932, to Dovell et al; U.S. Pat. No. 1,526,496, issued Feb. 17, 1925, to Hohnhorst et al; U.S. Pat. No. 2,742,891, issued Apr. 26, 1956, to Wise; and U.S. Pat. No. 1,805,514, issued May 19, 1931, to DeMattia, all included relatively complex mounting arrangements for holding the ball bearings in place in the body of the dresser. At the minimum, a number of screws would need to be removed from the dresser body in order to remove the bearings and cutter unit and substitute a new cutter unit. Further adjustments might also be required to set the cutter unit end play.

Many grinding wheel dressers are hand held and positioned manually on the grinding wheel tool rest during the dressing operation. In order to facilitate positioning of the dresser with respect to the wheel and to aid the operator in holding the dresser in position during the dressing operation, dressers, such as shown in Dovell et al, supra, include a pair of feet extending laterally from the body of the dresser. The dresser is positioned on the tool rest such that these feet extend over the edge of the rest closest to the grinding wheel. The dresser may then be pivoted about this edge of the tool rest to bring the cutter unit into contact with the grinding wheel, while keeping the teeth of the cutter unit properly aligned with the grinding surface of the wheel. Where the tool rest has become uneven through wear and one of both of the feet are held in contact with an uneven portion of the rest, the dresser may be misaligned with respect to the abrasive grinding wheel.

Other prior art dresser units have been permanently mounted on support structure adjacent the abrasive wheel, such that they may be pivoted into contact with the abrasive grinding wheel during the dressing operation. U.S. Pat. No. 272,615, issued Feb. 20, 1883, to Andrews; U.S. Pat. No. 1,349,452, issued May 11, 1920, to Gorham; and U.S. Pat. No. 1,811,933, issued June 30, 1931, to Hohnhorst et al, all disclose dressers which are permanently mounted adjacent a grinding wheel. Such dresser mounting arrangements have typically hindered the operator in use of the grinding wheel and, therefore, have not been widely used.

Accordingly, there is a need for an improved dresser utilizing ball bearing supports for the cutter unit and permitting the cutter unit to be changed rapidly and simply. Additionally, there is a need for an improved dresser permitting quick and accurate alignment of the cutter unit with respect to the grinding wheel. Also, a need exists for a dresser permanently mounted adjacent an abrasive grinding wheel which will not interfere with the use of the wheel.

SUMMARY OF THE INVENTION

A dresser for roughening the surface of an abrasive wheel includes cutter means for rotation against the abrasive wheel such that the wheel is dressed. The cutter means includes a plurality of cutter teeth mounted on a cutter surface. Ball bearing means are mounted at each end of the cutter shaft, permitting the cutter means to rotate freely when held against the abrasive wheel, as the wheel is rotated. A pair of polygonal bearing support means are provided with each support means defining a bearing receiving recess and a threaded, bolt receiving opening. Each of the bearing support means mounts one of the ball bearing means in the bearing receiving recess thereof. A dresser body defines a cavity receiving the cutter means, slot means on opposite sides of said cavity receiving said bearing support means, bolt holes extending from the exterior of the body into the cavity through each of the slot means, and a dresser handle. Cutter supporting bolts extend from the exterior of the dresser body through the bolt holes into the cavity and engage the threaded, bolt receiving openings in the bearing support means.

The dresser body may further comprise a pair of locating ridges on the exterior of the body and extending parallel to the cutter shaft, whereby either of the locating ridges may be placed against the abrasive wheel tool rest for aligning the cutter means with the abrasive wheel. Such an arrangement provides for accurate positioning of the dresser, notwithstanding irregularities in the abrasive wheel tool rest.

The dresser may also be pivotally attached to a dresser mounting plate which, in turn, is pivotally attached to the abrasive wheel tool rest such that the mounting plate may pivot about an axis which is perpendicular to the axis about which the dresser is pivoted with respect to the mounting plate. Such an arrangement permits rapid alignment of the dresser cutting means with respect to the abrasive wheel.

Accordingly, it is an object of the present invention to provide a dresser for roughening the surface of an abrasive wheel in which the cutter means, supported by ball bearings, may be quickly and easily replaced; to provide such a dresser in which the dresser body includes a pair of ridges for engaging the wheel tool rest to align the dresser with respect to the abrasive wheel; and to provide such a dresser in which the dresser is permanently attached to support structure adjacent the wheel in a manner such that the dresser will not interfere with the use of the wheel.

DETAILED DESCRIPTION OF THE PREFERRED EMBODIMENTS

Figures 1, 2, 3, 6:
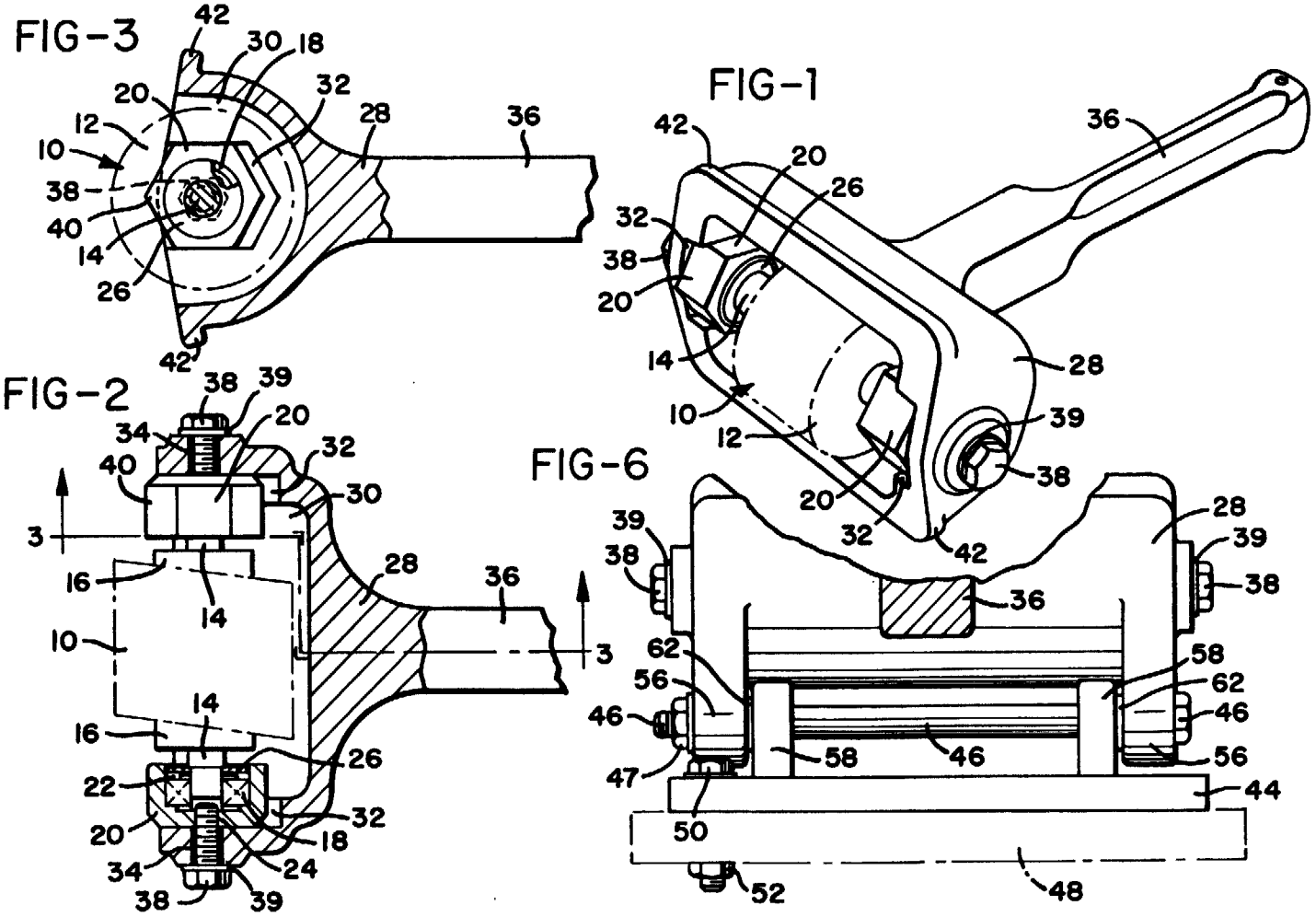
FIG. 1 is a perspective view of the dresser of the present invention.
FIG. 2 is a plan view of the dresser of FIG. 1, with portions of the dresser body broken away and in section to reveal interior structure.
FIG. 3 is a sectional view taken generally along line 3—3 in FIG. 2.
FIG. 6 is a sectional view, with portions broken away, taken generally along line 6—6 in FIG. 5.

Reference is now made to FIG. 1 which is a perspective view illustrating the dresser of the present invention. A cutter means 10 is provided for rotation in contact with an abrasive wheel to dress the wheel. The cutter means includes a plurality of cutter teeth 12, illustrated diagrammatically, which are mounted on a cutter shaft 14. The specific design of the cutter teeth 12 does not form a portion of the present invention and any prior art cutter tooth design, such as shown for example in the Devell et al U.S. Pat. No. 1,878,763, may be employed. The cutter means may further include a pair of sleeves 16 (FIG. 2) which are pinned to the shaft 14 to hold the teeth 12 on the shaft 14 in a desired orientation.

As seen in FIGS. 2 and 3, ball bearing means 18 are mounted at each end of the cutter shaft 14 to permit the cutter means 10 to rotate freely when held against a rotating abrasive wheel. A pair of polygonal bearing support means 20 each define a bearing receiving recess 22. The bearing support means 20 are shown as generally hexagonal in shape, although any polygonal shaped support, having opposite parallel sides, could be utilized. The bearing support means 20 each further define a threaded, bolt receiving opening 24. The ball bearing means 18 are pressed into the bearing receiving recesses 22 and dust slinger washers 26 are mounted on each end of the cutter shaft 14 for protecting the ball bearing means 18 from abrasive particles removed from the surface of an abrasive wheel during the dressing operation.

A dresser body 28 defines a generally semi-cylindrical cavity 30 for receiving the cutter means 10. Slot means 32 on opposite sides of the cavity 30 receive the bearing support means 20. Bolt holes 34 extend from the exterior of the body 28 into the cavity 30 through each of the slot means 32. A dresser handle 36 is provided so that the operator may firmly grasp the dresser during the dressing operation. Cutter supporting bolts 38 extend from the exterior of the dresser body 28 through the bolt holes 34 into the cavity 30 and engage the threaded bolt receiving openings 24 in the bearing support means 20. Lock washers 39 may be positioned on bolts 38 between the bolt heads and the dresser body 28.

The bearing arrangement illustrated in FIGS. 1-3 provides substantial improvement over ball bearing supports previously used in abrasive wheel dressers. As seen in FIG. 3, the polygonal bearing support means 20 includes a forward extending portion 40 which provides a measure of protection to the bearings and the dresser body 28. Should the operator carelessly permit the bearing support arrangement to come into contact with the rotating abrasive wheel during a dressing operation, edge 40 will contact the wheel first, preventing the body 28 from being damaged. Bolts 38 may thereafter be removed, allowing the bearing support means 20 to be removed from the slots 32, rotated, and reinserted into the slots. A new protective edge 40 will thus be provided should the bearing support means 20 again come into contact with the abrasive wheel.

It should be noted that only two bolts need be removed to permit the cutter means 10 to be replaced. Since the cutter shaft 14 slidably engages the ball bearing means 18, the cutter means may be removed from the ball bearing means 18 without the need for special tools.

Further, the cutter supporting bolts 38 extend into the interior of the ball bearing means 18, with the length of the bolts 38 selected to provide a minimal clearance between the bolts 38 and the ends of shaft 14. Since the bolts 38 will be formed of a steel which is substantially harder than that from which the shaft 14 is formed, the clearance between the ends of the bolts 38 and the shaft 14 will define the maximum permissible end play for the cutter means 10. Any wear which may occur as a result of contact between the shaft 14 and the bolts 38 will occur on the ends of shaft 14. Thus when a new cutter means is inserted into the dresser, the bolts 38 need not be replaced.

The dresser body 28 further defines a pair of locating ridges 42 on the exterior of the body. These ridges extend parallel to the cutter shaft 14 such that either of the locating ridges may be placed against an abrasive wheel tool rest for aligning the cutter means with respect to the abrasive wheel. This configuration is a substantial improvement over prior art dressers having only a pair of feet extending outwardly on one side of the dresser body. The dresser illustrated in FIGS. 1-3 may be placed on the abrasive wheel tool rest without regard to which side of the dresser is in contact with the tool rest. Further, the use of ridges 42 extending along the entire length of the dresser body permits the dresser to be aligned with the abrasive wheel properly, regardless of any irregularities in the tool rest surface. The ridges 42 will tend to bridge any such irregularities in the tool rest.

Figure 4:
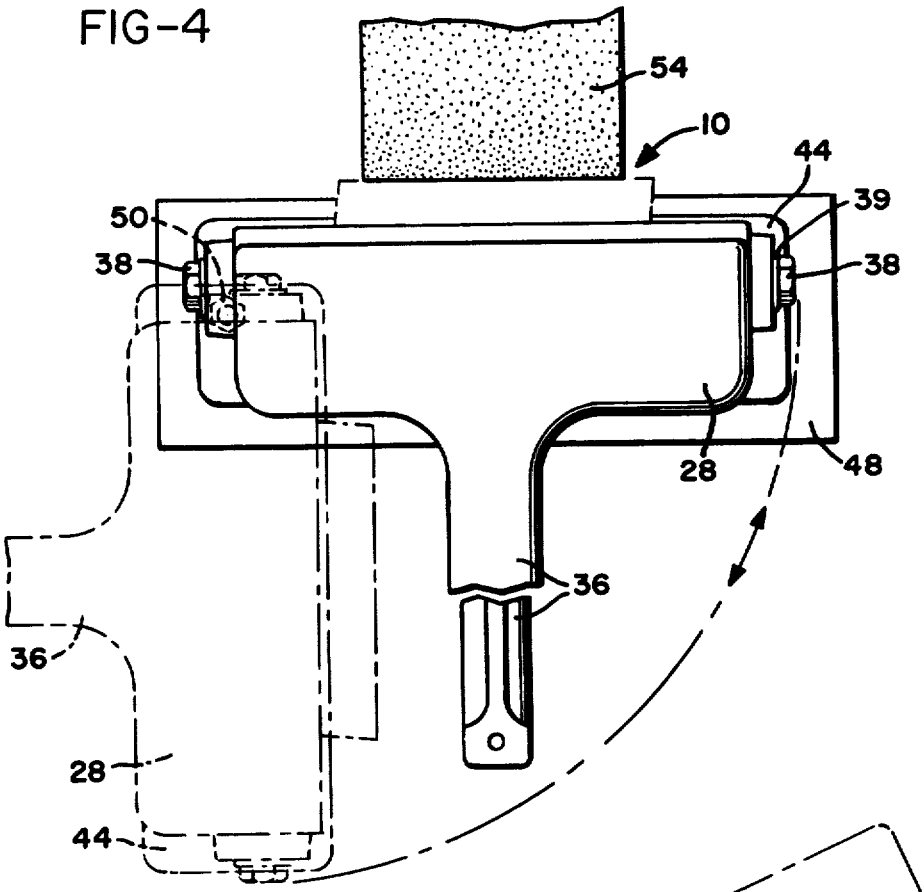
FIG. 4 is a plan view of an alternative embodiment of the dresser of the present invention.
Figure 5:
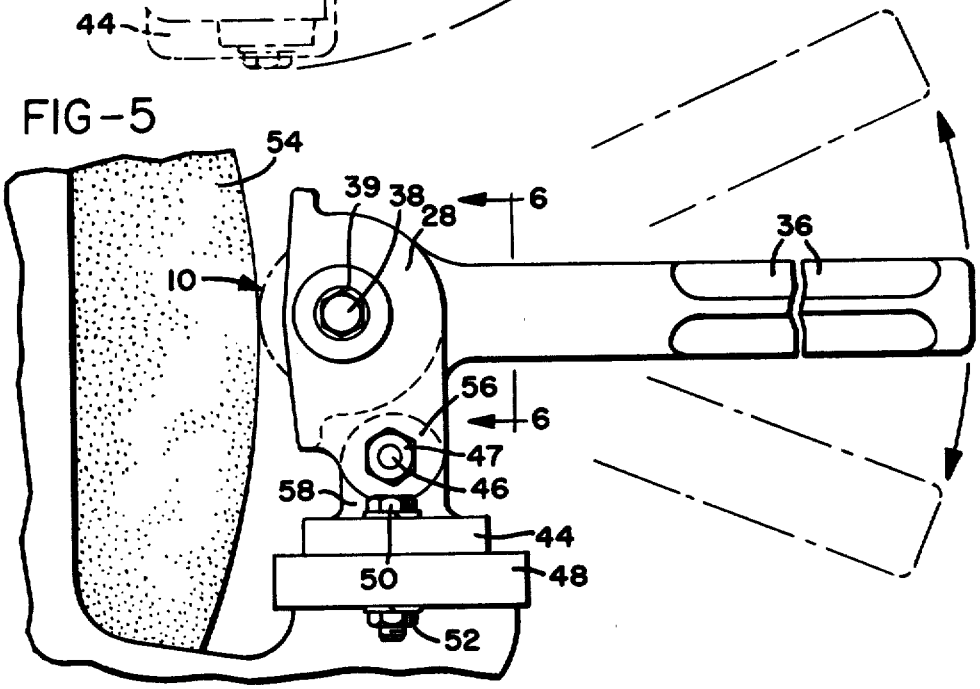
FIG. 5 is a side view of the dresser of FIG. 4, as seen looking left to right in FIG. 4.

Reference is now made to FIGS. 4-6, which illustrate an alternative embodiment of the present invention. The same cutter means, bearings, and bearing supports described with respect to FIGS. 1-3 are utilized in the alternative embodiment and, where shown, are given the same reference numerals. As seen in FIGS. 4 and 5, a dresser mounting plate 44 is provided for mounting the dresser body 28. Means for pivotally attaching the dresser body 28 to the mounting plate 44 such that the dresser body may be pivoted with respect to the mounting plate about an axis which is parallel to the cutter shaft includes a bolt 46 and a lock nut 47. A means for pivotally attaching the mounting plate 44 to abrasive wheel tool rest 48 includes bolt 50 and a lock nut 52.

The mounting plate 44 may therefore be pivoted, as shown in FIG. 4, about an axis which is perpendicular to the axis about which the dresser body is pivoted with respect to the mounting plate 44. As shown in FIG. 4, the mounting plate 44 may be pivoted to the position shown by the dashed lines such that the dresser will not interfere with the operator's use of the abrasive wheel 54.

When the abrasive wheel 54 requires dressing, the plate 44 with the dresser pivotally mounted thereon is moved into the position shown in solid lines in FIG. 4 and dressing effectuated by pivoting the dresser about the bolt 46, as shown in FIG. 5. The cutter means 10 of the dresser of FIGS. 4–6 is of sufficient width that it extends completely across the abrasive wheel 54.

As seen especially in FIG. 6, a pair of outwardly extending bosses 56 on the exterior of the dresser body 28 and a pair of bosses 58 on the mounting plate 44 each define a bolt hole through which the bolt 46 extends. The lock nut 47 engages the end of the bolt 46 to secure the bolt in position. If desired, washers 62 may be positioned between bosses 56 and 58 to facilitate pivoting of the dresser body 28.

It will be appreciated that variations in the mounting arrangement illustrated in FIGS. 4–6 will come within the scope of the present invention. The mounting plate 44 may, for instance, be pivotally attached to a guard for the grinding wheel or other such structure. In such an arrangement, the dresser could pivot into position in contact with the abrasive grinding wheel at a point substantially above the point at which the wheel will contact a work piece supported by the tool rest 48.

While the forms of apparatus herein described constitute preferred embodiments of the invention, it is to be understood that the invention is not limited to these precise forms of apparatus, and that changes may be made therein without departing from the scope of the invention.

What is claimed is:

1. A dresser for roughening the surface of an abrasive wheel, comprising:

cutter means for rotation about an axis in contact with said abrasive wheel such that said wheel is dressed, said cutter means including a plurality of cutter teeth mounted on a cutter shaft, ball bearing means mounted at each end of said cutter shaft, permitting said cutter means to rotate freely about said axis when held against said abrasive wheel as said wheel is rotated, a pair of polygonal bearing support means, each support means defining a bearing receiving recess and a threaded, bolt receiving opening, and each of said pair of bearing support means mounting one of said ball bearing means in said bearing receiving recess thereof such that said bolt receiving opening is axially aligned with said axis of said cutter means, a dresser body, defining a cavity receiving said cutter means, slot means on opposite sides of said cavity receiving said bearing support means, bolt holes extending from the exterior of said body into said cavity through each of said slot means and axially aligned with said bolt receiving openings and with said axis of said cutter means, said dresser body further including a dresser handle, and cutter supporting bolts extending from said exterior of said dresser body through said bolt holes into said cavity and engaging said threaded, bolt receiving openings in said bearing support means.

2. The dresser of claim 1 in which said ball bearing means includes dust slinger washers mounted on each end of said cutter shaft between said cutter teeth and said ball bearing means, whereby said ball bearing means are protected from abrasive materials.

3. The dresser of claim 1 in which said dresser body further comprises a pair of locating ridges on the exterior of said body extending parallel to said cutter shaft on opposite sides of said cavity, each of said locating ridges extending substantially the length of said cavity, whereby either of said locating ridges may be placed against an abrasive wheel tool rest for aligning said cutter means with said abrasive wheel such that irregularities in said abrasive wheel tool rest will not result in misalignment of said cutter means.

4. The dresser of claim 1, further comprising:

a dresser mounting plate, means for pivotally attaching said dresser body to said mounting plate such that said dresser body may be pivoted with respect to said mounting plate about an axis which is parallel to said cutter shaft, and means for pivotally attaching said mounting plate to an abrasive wheel tool rest for pivoting said mounting plate with respect to said tool rest about an axis which is perpendicular to the axis about which said dresser body is pivoted with respect to said mounting plate, whereby said dresser cutter means may be rapidly aligned with said abrasive wheel.

5. The dresser of claim 4 in which said means for pivotally attaching said dresser body to said mounting plate comprises:

a pair of bosses on the exterior of said dresser body, each defining a bolt hole, a pair of bosses on said mounting plate, each defining a bolt hole, a bolt extending through said bolt holes in said bosses on said dresser body and said bolt holes in said bosses on said mounting plate, and a lock nut engaging said bolt, whereby said dresser body may be pivoted such that said cutter means contacts said abrasive wheel for roughening the surface thereof.

6. The dresser of claim 1 in which said polygonal bearing support means are substantially hexagonal.

7. The dresser of claim 1 in which said cutter supporting bolts extend into said bearing receiving recesses of said bearing support means to limit movement of said cutter means with respect to said ball bearing means.

* * * * *